US007654268B2

(12) United States Patent
Carpenter

(10) Patent No.: US 7,654,268 B2
(45) Date of Patent: Feb. 2, 2010

(54) ARTIFICIAL NAIL FORM

(76) Inventor: June Carpenter, 11 Cindy St., Old Bridge, NJ (US) 08857

( * ) Notice: Subject to any disclaimer, the term of this patent is extended or adjusted under 35 U.S.C. 154(b) by 533 days.

(21) Appl. No.: 11/443,609

(22) Filed: May 31, 2006

(65) Prior Publication Data

US 2007/0277840 A1 Dec. 6, 2007

(51) Int. Cl.
*A45D 29/00* (2006.01)

(52) U.S. Cl. ..... 132/73; 132/285

(58) Field of Classification Search ..... 132/73, 132/285, 73.5

See application file for complete search history.

(56) References Cited

U.S. PATENT DOCUMENTS

| | | | | |
|---|---|---|---|---|
| 1,231,270 | A * | 6/1917 | Knudsen | 132/73.5 |
| 2,031,225 | A * | 2/1936 | O'Donnell | 132/285 |
| 4,222,399 | A | 9/1980 | Ionescu | |
| 4,287,899 | A * | 9/1981 | Robichaud | 132/73 |
| 4,577,648 | A * | 3/1986 | Dinerstein et al. | 132/73 |
| 4,682,612 | A | 7/1987 | Guiliano | |
| 4,690,369 | A | 9/1987 | Guiliano | |
| 4,718,957 | A | 1/1988 | Sensenbrenner | |
| D300,267 | S | 3/1989 | McCormick | |
| D334,997 | S | 4/1993 | McCormick | |
| 5,803,094 | A * | 9/1998 | Becker et al. | 132/200 |
| 5,848,597 | A | 12/1998 | Carpenter | |
| D426,919 | S | 6/2000 | Bachik, Jr. | |
| 6,357,451 | B1 * | 3/2002 | Carter | 132/200 |
| D496,130 | S | 9/2004 | De Polo et al. | |

* cited by examiner

*Primary Examiner*—Robyn Doan

(57) ABSTRACT

An artificial nail forming device is disclosed which is formed of stamped sheet metal and has a front section and a rear section formed by an intermediate opening between the sections. The rear section has bendable ears for attaching the device to a finger so the natural nail of the finger is exposed in the opening. The front section of the device has an outer surface that defines orthogonal curvatures that simulate the orthogonal curvatures of a natural nail. The exposed nail has its tip overlying the front section outer surface so that the artificial nail can be applied to the exposed natural nail and to the device front section outer surface. After curing, the artificial nail is separated from the forming device by pressing on two tabs extending from the front section to bend and thus displace the front section relative to the rear section and to the finger. This displacement breaks the bond between the artificial nail and the front section.

14 Claims, 6 Drawing Sheets

ARTIFICIAL NAIL FORM

This invention relates to forms or molds for creating artificial fingernails in situ on a person's fingernail.

Of interest is my U.S. Pat. No. 5,848,597 ('597) which discloses a nail wrap molder for creating silk or acrylic artificial fingernails and which is incorporated by reference in its entirety herein.

Silk artificial nails comprise a flexible fabric grid in combination with an acrylic mass. In the alternative, artificial nails may be made with the acrylic mass per se without the fabric. The acrylic mass tends to adhere to plastics such that the form for such artificial nails is made of metal or metal foil from which the cured nail is readily separated.

Another way to create an artificial nail is to apply the acrylic mass directly to the fingernail and at the same time apply the mass over the metal form of the '597 patent to create an enlarged artificial nail.

Another technique to employ artificial nails, typically molded plastic, on a fingernail is to use commercially available artificial nails. These are manufactured for general use and are not made to fit any given finger an thus tend to be unattractive as being obviously artificial. The user glues such nails to their existing natural fingernails. These are preformed nails that generally have the configuration of natural fingernails in that they tend to employ the complex natural curvature of natural nails. To attach these artificial nails requires substantial abrasion of the natural nail which leads to long term undesirable effects. Also these type of nails tend to "pop" off of the natural nail.

It is most desirable to have an artificial nail that follows the complex natural curvature of a natural nail. Such curvature extends in two orthogonal directions along the finger length direction and in a direction transverse to the finger length direction. My prior patent discussed above discloses a form for creating an artificial nail that has such mutually perpendicular curvatures. Also the manufactured preformed nails also have such curvatures. However, all previously known forms to the present inventor's knowledge permit nails to be created with curvature only along one axis and not mutually perpendicular axes as occurs with natural nails. Some prior art forms require unsatisfactory procedures utilizing a split form in an attempt to provide an artificial nail with a curvature on a second axis.

The problem with my prior art form described in the '597 patent is that while it is made of metal, during manufacturing metal fatigue tends to occur at the edges of sharp bends required in that form shape. Such bends are present where the finger abutment wall meets the curved form surface where the new nail is constructed. The form thus tends to crack at such bends and, thus has not been successful. As noted above, plastic molded forms are also not practical as the acrylic mass used to create silk or acrylic artificial nails adhere to such a plastic form and thus are not readily separable therefrom and usable therewith.

U.S. design Pat. No. 426,919 discloses a form with a punch out center for use in applying artificial fingernails. U.S. Pat. No. 4,682,612 discloses a process and article for preparing artificial nails. Disclosed are coating compositions which are cured in the presence of ultraviolet light to provide a hard, flexible artificial nails having the general appearance of natural nails using prior art forms and which can be used with prior art techniques for coating artificial nail compositions on a digit. Novel forms are also disclosed.

U.S. Pat. No. 4,222,399 discloses an artificial nail built up on a flat flexible resilient arcuate form which mounted on a human nail. The artificial nail is formed by depositing a layer of mush of resin powder and a liquid solvent on the form while it is in place on the actual nail. The form is removed from the human nail and the mush layer allowed to become almost dry to a soft cohesive layer. The cohesive layer is then peeled from the form and placed on the human nail using a glue layer applied to the human nail.

U.S. Pat. No. 4,718,957 discloses a process of creating an artificial fingernail using either a natural nail or a model of the natural nail as a substrate in conjunction in each case with a secondary substrate forming an extension of the nail and digit to accept in a continuous fashion a release agent and a coating of a curable material for curing an acrylic material using a light source in the visible spectrum.

Design Pat. Nos. 334,997 discloses an artificial nail form and 496,130 discloses an industrial model of a mold for fingernails. All of the above patents are incorporated by reference herein in their entirety.

None of the above patents disclose forming a nail with the complex curvature of a natural nail with a simple low cost device and also a simple procedure for removing the artificial nail from the natural nail when the process is finished in view of the fact that the artificial nail tends to adhere to the prior art forms and may be difficult to remove from the forms in some instances. The present inventor recognizes a need for a form to create an artificial nail that follows the natural curvature of a human nail, is made of metal and is long lasting and reliable and yet simple to use and low cost to fabricate.

A nail form for use in creating and attaching an artificial fingernail to a natural fingernail according to an embodiment of the present invention comprises a sheet material longitudinal member defining a longitudinal axis and having a convex outer surface and a concave inner surface. The member has front and rear sections defined by an opening therebetween, the rear section concave inner surface for receiving a finger, the front section outer surface for forming the artificial nail. The rear section includes an attachment arrangement for releasably attaching the member to the received finger such that the natural nail of the received finger is exposed through the opening with a tip nail portion overlying a portion of the front section convex outer surface. The front section convex surface define orthogonal curvatures mimicking the orthogonal curvatures of a natural nail.

In a further embodiment, the front section includes at least one tab extending radially outwardly therefrom for separating the formed artificial nail from the front section outer surface. Preferably, the at least one tab includes a pair of tabs extending outwardly from the front section in opposing directions transverse the longitudinal axis. More preferably, the tabs extend from the front section in mirror image relationship.

In a further embodiment, the front section terminates at first and second longitudinal edges, a tab extending from each said first and second longitudinal edges.

In a still further embodiment, the attachment arrangement comprises a pair of bendable ears extending transverse to the axis in opposite directions from the rear section. Preferably, the ears are for manual bending about the finger and the tabs are flat and approximately coplanar. More preferably, the ears are generally flat and coplanar. And more preferably, the rear section has opposite longitudinal edges, each ear extending from a different longitudinal rear section edge In a further embodiment, a method of forming an artificial nail comprises mounting and securing a finger in a concave cavity of an artificial nail forming device with the fingernail exposed. Overlying the tip of the fingernail on an artificial nail forming surface of the device, the device nail forming surface having orthogonal nail forming curvatures; and then applying the artificial nail to the exposed fingernail and to the nail forming device nail forming surface.

In a further embodiment, the method includes displacing a first portion of the nail forming device having the applied artificial nail relative to the finger to separate the artificial nail from the device nail forming surface.

Preferably, the mounting step includes mounting the finger in fixed relationship to a second portion of the nail forming device and the displacing step includes displacing the first portion of the nail forming device relative to the second portion. Preferably, the displacing step includes forming the device with a pair of tabs and then pushing on the tabs.

In a further embodiment, the mounting step includes wrapping at least one ear attached to the device about the finger.

An artificial nail forming method according to a further embodiment, comprises forming a sheet material longitudinal member defining a longitudinal axis and having a convex outer surface and a concave inner surface, forming the member with front and rear sections defined by an opening therebetween and forming the rear section concave inner surface for receiving a finger, the front section outer surface for forming the artificial nail, forming the front section convex surface with orthogonal curvatures mimicking the orthogonal curvatures of a natural nail, attaching the rear section to the received finger such that the natural nail of the received finger is exposed through the opening with a finger tip nail portion overlying a portion of the front section convex outer surface, forming the artificial nail; and then separating the artificial nail from the member by pushing on the front section relative to the rear section.

IN THE DRAWING

Figure 1:
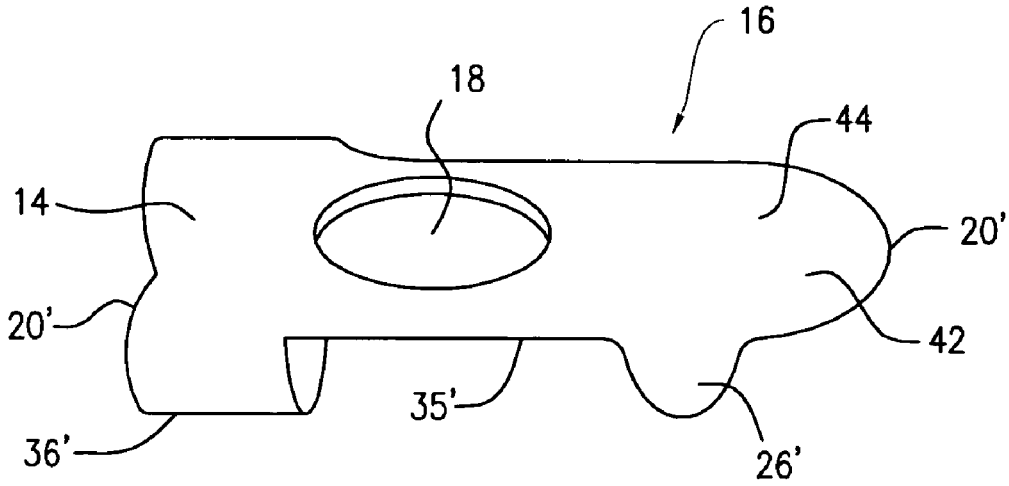
FIG. 1 is a perspective view of the artificial nail forming device according to an embodiment of the present invention when it is ready to receive a finger to which an artificial nail is to be formed and attached.
Figure 2:
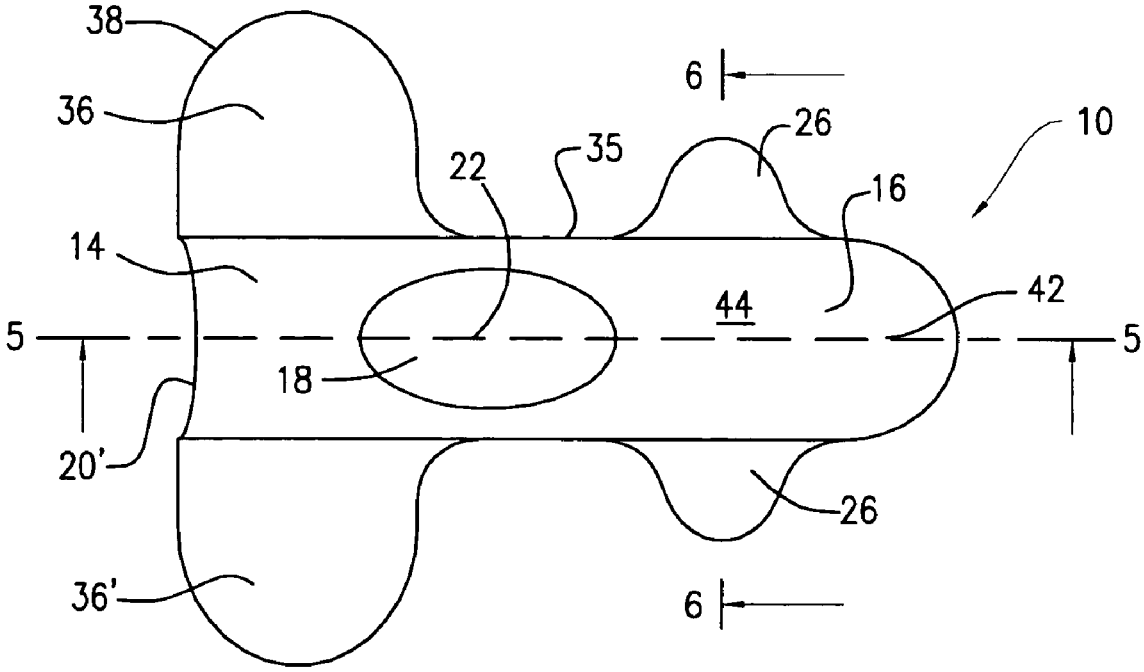
FIG. 2 is a plan view of the device of claim 1 prior to bending of the finger attaching arms at the rear section of the device.
Figure 3:
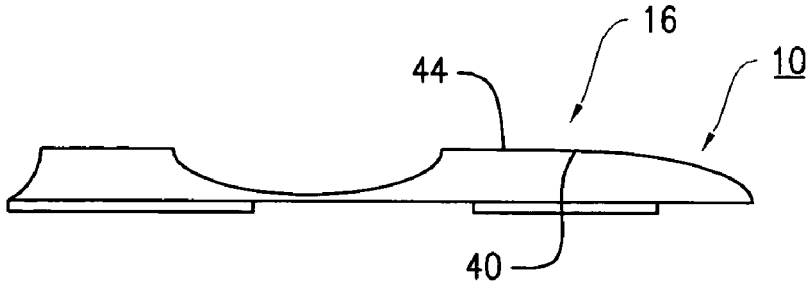
FIG. 3 is a side elevation view of the embodiment of the device of FIG. 2
Figure 4:
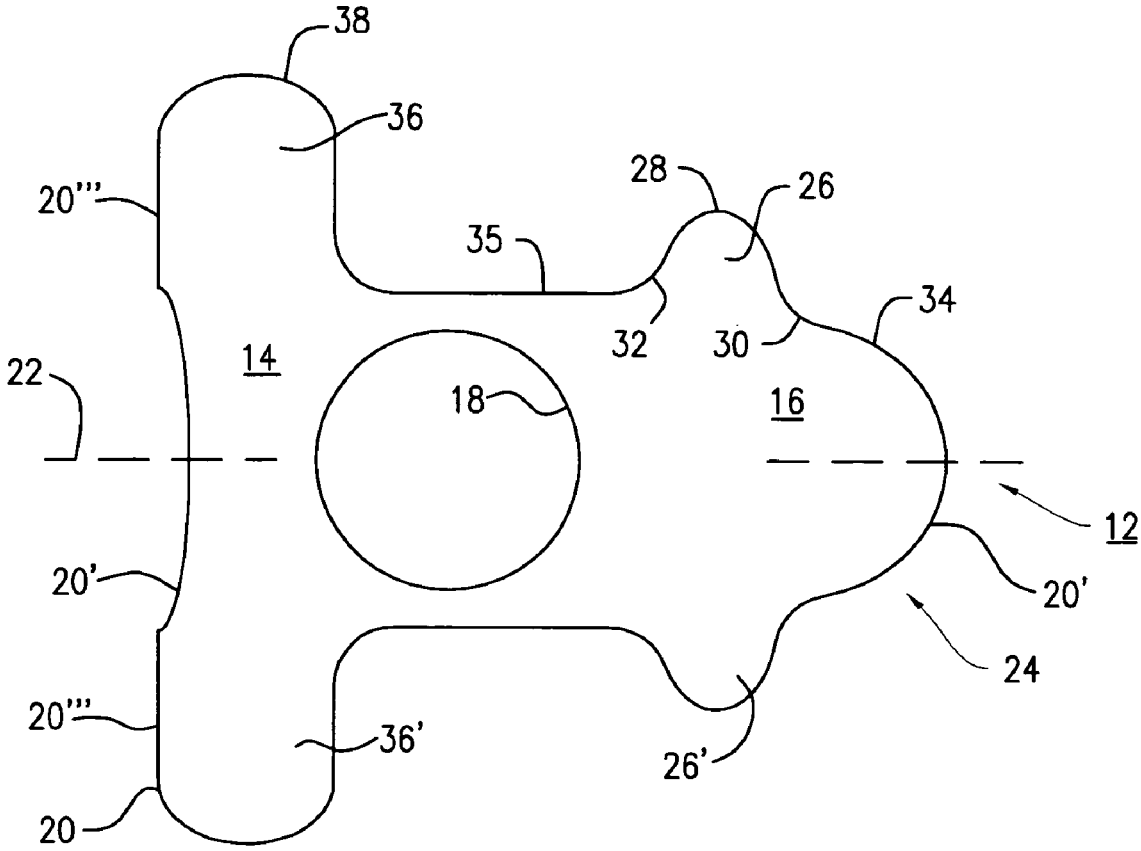
FIG. 4 is a plan view of the flat sheet material blank which forms the device prior to forming by stamping the three dimensional convex-convex configuration of the device of FIG. 3.

In FIGS. 2, 3 and 5-6, artificial nail forming device 10 is formed from a blank 12, FIG. 4, stamped from sheet metal of the type as known in this art. The sheet metal is thin and readily bendable manually. It may be tin or an alloy similar thereto as known. Reference is made to the patents in the introductory portion incorporated by reference herein for further materials forming an artificial nail forming device.

In FIG. 4, the blank 12 is in the flat state after stamping from the sheet metal material. The blank has a rear section 14 and a front section 16 formed by an opening 18 in the sheet material between the sections. The blank has an outer peripheral edge 20 that is symmetrical about longitudinal axis 22. The blank 12 extends longitudinally along the axis 22 terminating at a convex curved front edge 20' at the front portion 24 of the blank. One half side of the blank 12 will be described as being representative since the opposite side is in mirror image relation thereto.

A tab 26 is positioned slightly rearward of the edge 20' and extends outwardly from the blank 12 in a direction that is normal to axis 22. The tab 26 has a convex arcuate end portion 28 by way of example. The tab may be of any desired shape. The tab 26 edge is formed with radii 30, 32 at the tab junction with the remainder of the blank 12. The radii 30 is connected to the front edge 20' by a reverse bend portion 34 of the edge 20. The tab 26 has a mirror image tab 26' on the opposite side of the blank 12.

The edge 20 continues linearly in portion 35 generally parallel to the axis 22 rearwardly to the rear section 14 and toward ear 36. Ear 36 extends transversely outwardly from the rear section 14 in a direction normal to the axis 22. The ear 36 is defined by an arcuate outer peripheral edge 38 which is a continuation of edge 20. The ear 36 has a transverse length sufficient to wrap sufficiently about a finger to attach the device 10 to a finger. The ear 36 cooperates with the mirror image ear 36' on the opposite side of the blank 12 to attach the device 10 to the finger. In FIG. 4, the ears 36, 36' and tabs 26, 26' are flat and coplanar with the rest of the blank 12 and each other. The edge 20 has a concave portion 20" at the rear most edge of the blank 12. The ears 36, 36' have a linear edge 20'".

Figure 5:
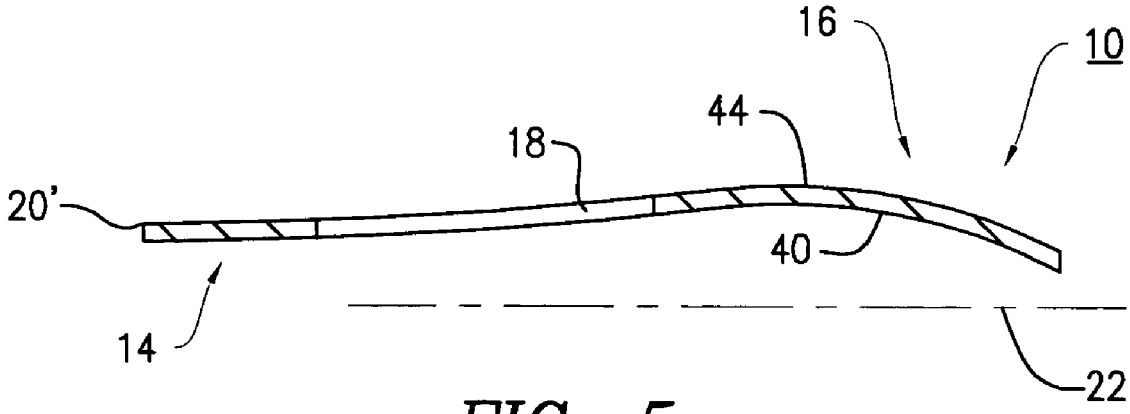
FIG. 5 is a sectional elevation view of the embodiment of FIG. 2 taken at lines 5-5.
Figure 6:
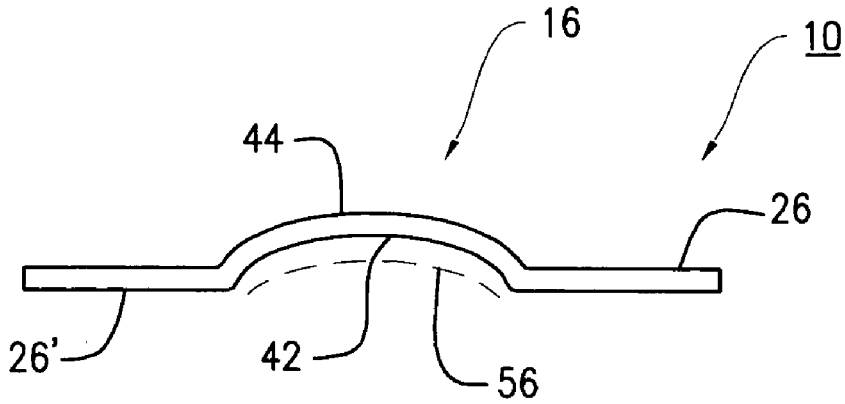
FIG. 6 is a sectional elevation view of the embodiment of FIG. 2 taken at lines 6-6.

In FIGS. 2, 3, 5 and 6 the device 10 is shown after being stamped into its final configuration. In FIGS. 3, 5 and 6, the device 10 has a front section 16 that has a convex outermost surface on which the artificial nail is formed and formed with two orthogonal curvatures 40 and 42. The front section is concave on its opposite surface. The curvature 40 mimics and represents the continuation of the curvature of a natural nail in the longitudinal direction of the corresponding finger (corresponding to axis 22 of the device 10). Curvature 42 is transverse to the curvature 40, is normal thereto, and mimics and represents the curvature of the natural nail in a direction normal to the curvature 40 (and to the axis 22 of the device 10). All bends are in relatively large radii to avoid metal fatigue and fracturing that might otherwise occur.

Figure 7:
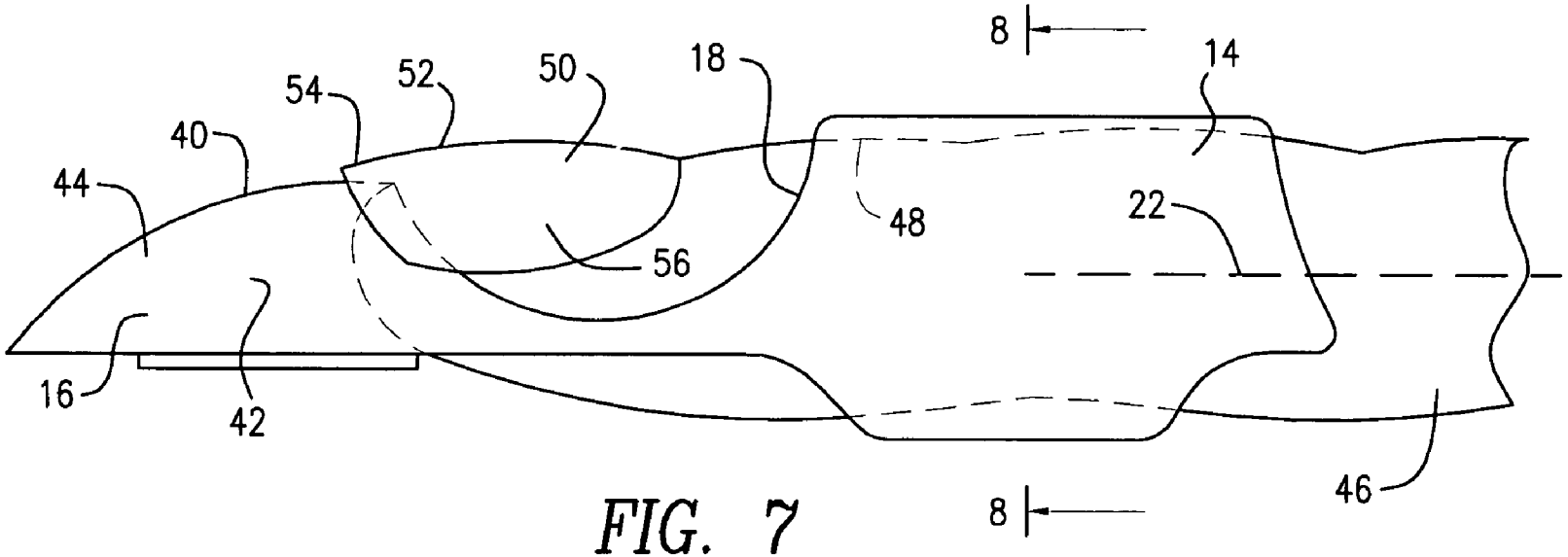
FIG. 7 is a side elevation view of the embodiment of FIG. 1 with a finger attached to the device prior to forming the artificial nail and showing the position of a finger relative to the artificial nail forming device.
Figure 8:
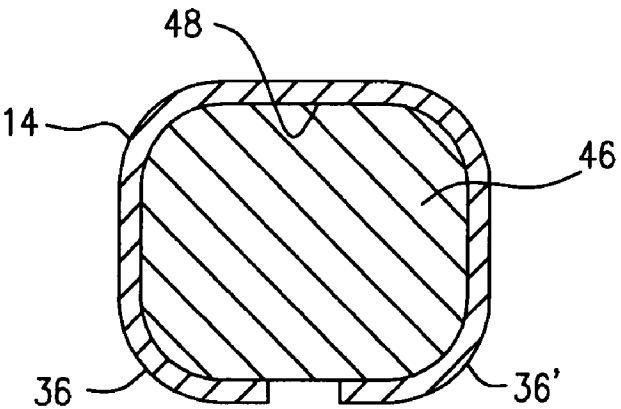
FIG. 8 is a sectional elevation view of the embodiment of FIG. 7 taken at lines 8-8.

In operation, in FIGS. 7 and 8, a finger 46 is placed in the concavity 48 of the device 10 rear section 14. The ears 36, 36' are then manually bent about the finger to secure the device 10 temporarily to the finger. See FIG. 8. In This position, the natural nail 50, FIG. 7, which has a natural curvature 52 which extends along the device axis 22, is exposed through the opening 18. The nail has a tip portion 54 which overlies a portion of the device front section 16 outer surface 44. The front section edge forming a portion of the opening 18 may abut the finger tip just beneath the nail tip portion 54. As seen in FIG. 7, the natural curvature 52 of the nail extending in the direction of the axis 22 is continued by the outer surface 44 of the front section curvature 40.

The transverse curvature of the natural nail (shown in dashed lines in FIG. 6) is continued by the transverse curvature 42 of the front section 16 of the device 10.

Figure 9:
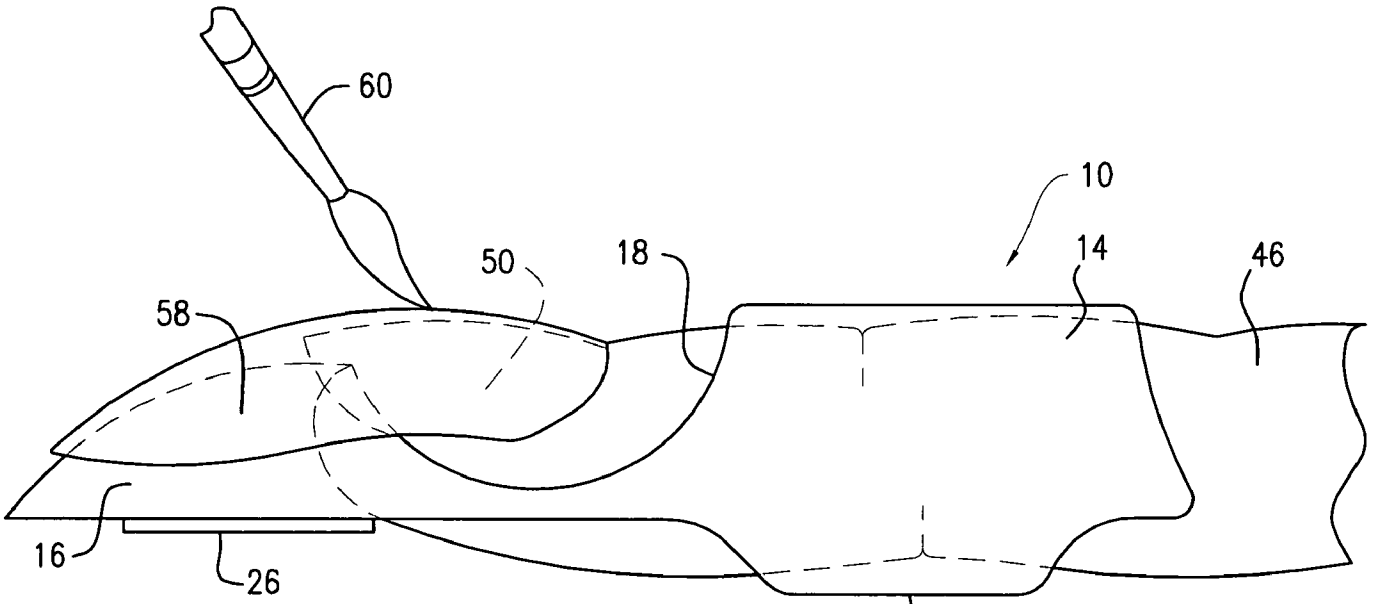
FIG. 9 is a side elevation view similar to the embodiment of FIG. 7 with an artificial nail being applied to the finger natural nail.

In FIG. 9, the artificial nail 58 acrylic mass is shown being applied by brush 60 (which is merely illustrative of the application process which may be by other means, not shown). The brush is applying acrylic mass in this case, but other coatings and material may be applied as disclosed in more detail in several of the patents noted in the introductory portion and incorporated by reference herein. See for example, U.S. Pat. No. 4,682,612 which discloses various compositions for forming artificial nails. Also see my '597 patent for silk wrap artificial nails and so on.

Figure 10:
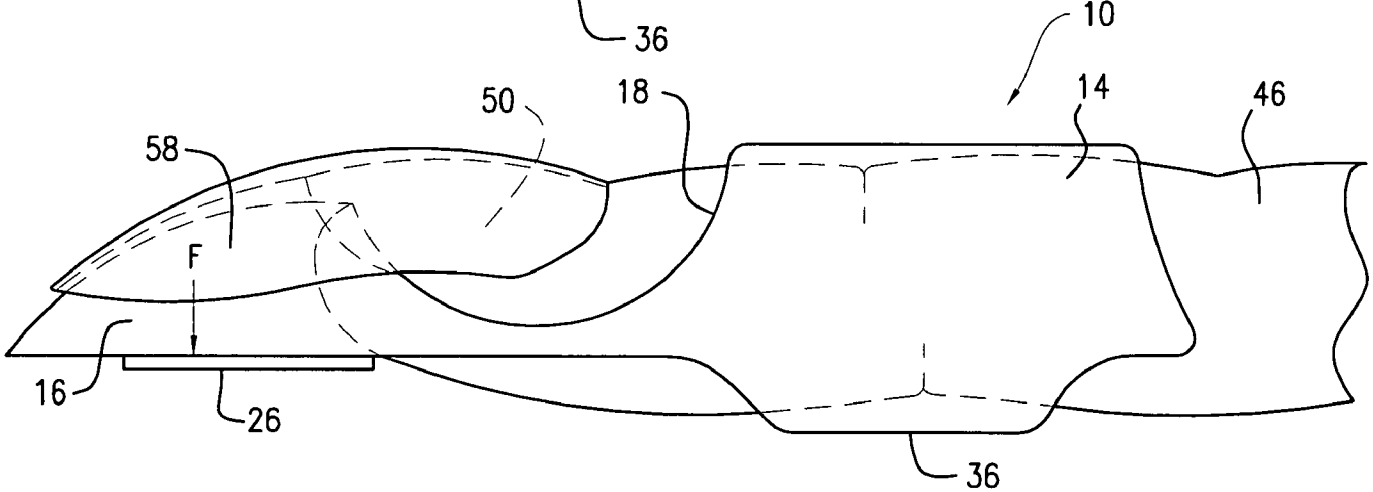
FIG. 10 is a side elevation view similar to the embodiment of FIG. 9 showing the artificial nail forming device being separated from the formed artificial nail.
Figure 11:
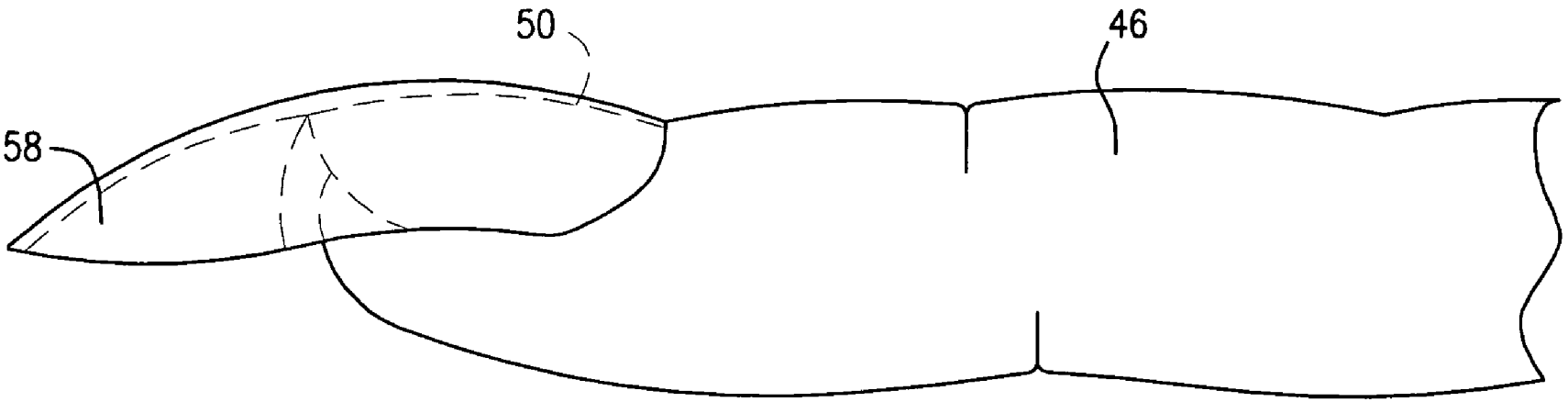
FIG. 11 is a side elevation view similar to the embodiment of FIG. 10 showing the artificial nail and finger removed from the nail forming device.

In FIG. 10, a force F is applied to the tabs 26 and 26' (not shown in this figure) simultaneously. This tends to bend the front section 16 slightly relative to the rear section 24 and also relative to the finger 46 captured to the rear section by ears 36, 36' (FIG. 8). This bending of the front section relative to the rear section displaces the front section 16 also relative to the artificial nail that is now adhered to and part of the natural nail 50. This action breaks the bond between the artificial nail and the front section 16 outer most surface 44 on which the artificial nail was formed. Thus the artificial nail is easily separated from the device 10. in FIG. 10, the device 10 is removed from the finger 46 whereby the artificial nail is now adhered to the natural nail and covers it in a natural look by duplicating the various curvatures of the natural nail.

There thus has been described a nail form, device 10, for use in creating and attaching an artificial fingernail, such as nail 58, to a natural fingernail, such as nail 50 which comprises a sheet material longitudinal member, such as blank 12, forming device 10 and defining a longitudinal axis such as axis 22 and having a convex outer surface such as surface 44 and a concave inner surface forming a concavity such as concavity 48, the member having front and rear sections such as sections 16 and 14, respectively, defined by an opening 18 therebetween, the rear section concave inner surface for receiving a finger 46, the front section 16 outer surface 44 for forming the artificial nail 58.

The rear section 14 including an attachment arrangement, such as ears 36, 36' for example, for releasably attaching the member to the received finger such that the natural nail 50 of the received finger 46 is exposed through the opening with a tip nail portion 54 overlying a portion of the front section 16 convex outer surface 44. The front section convex surface 44 defines orthogonal curvatures 40 and 42 simulating the orthogonal curvatures 52, 56 of a natural nail.

One aspect of the present invention, (as disclosed in Giuliano U.S. Pat. No. 4,690,369) contemplates the use of photopolymerizable compositions, i.e. compositions wherein curing to form the hard artificial nail is initiated by actinic radiation. In general, the prior art, both the patent literature and polymer texts, is replete with reference to such compositions and they are accordingly not novel in the context of the present invention. Typically, these prior art compositions may include at least one suitable polymer or oligomer, a photoinitiator and a liquid monomer in which the various other ingredients are soluble, the monomer being cross-linkable with the polymer in the presence of actinic radiation, e.g. ultraviolet (UV) radiation to form the desired solid plastic. As is understood in the art, the degree of firmness is in part dependent upon the degree of cross-linking and one skilled in the art understands that varying the ratio of monomer to polymer can provide greater or lesser firmness or rigidity of the product. In general, these liquid compositions may be characterized as being solvent-free and possessing an excellent shelf life, being capable of being stored in the absence of actinic radiation for long periods of time.

The photopolymerizable compositions for use in the present invention are characterized as being free from volatile or toxic components and they should not, of course, contain any skin irritants. Upon curing, they provide an artificial nail which is hard but has a degree of flexibility comparable to natural nails so as to minimize the likelihood of breaking upon contact with hard objects. The cured product is water-insoluble and not be affected by contact with detergents, e.g. the ordinary household detergents one typically encounters. Further, the cured product provides a smooth, preferably shiny, uniform coating which is esthetically pleasing and will readily accept the nail polishes or lacquers customarily used. The composition adheres well directly to the natural nail without the aid of tie coats, base coats or the like. It should also be easily cut or sanded to shape.

All of the foregoing characteristics will be readily apparent to one skilled in the art in the light of the present description. Likewise, one skilled in the art will readily understand and appreciate the various classes of ingredients heretofore known and used in the photopolymerizable polymer art which may be selected for use in the present invention. Accordingly, these ingredients need not be discussed in any great detail.

The liquid monomers which may be used may be selected from a long list of those heretofore employed in the art, themethacrylates being particularly preferred. Included are both mono- and poly-functional monomeric materials, the latter having more reactive sites to increase the crosslink density. [As will be appreciated, this is a useful way of varying the degree of hardness according to one's particular desires.] Partially polymerized monomers as well as mixtures of monomers are also contemplated.

As examples of monomers heretofore employed and which may be useful, mention may be made of butanediol dimethacrylate, butoxyethyl methacrylate, butyl methacrylate, diethylaminoethyl methacrylate, diethylene glycol dimethacrylate, dimethylaminoethyl methacrylate, ethylene glycol dimethacrylate, 2-ethylhexyl methacrylate, ethoxyethyl methacrylate, glycidyl methacrylate, hydroxyethyl methacrylate, hydroxypropyl methacrylate, methyl methacrylate, neopentyl glycol dimethacrylate, polyethylene glycol dimethacrylate, tert.-butyl-aminoethyl methacrylate, triethylene glycol dimethacrylate, tetrahydrofufuryl methacrylate and trimethylolpropane trimethacrylate. Other monomers which may be used includes acrylates such as butylene glycol diacrylate, n-butylacrylate, diethylaminoethyl acrylate, 2-ethylhexyl acrylate, ethoxyethyl acrylate, hexanediol diacrylate, polyethylene glycol diacrylate, phenoxyethyl acrylate, pentaerythritol triacrylate, trimethylolpropane triacrylate, triethylene glycol diacrylate, etc.; acrylamides such as N-isobutoxymethylacrylamide, N-methylolacrylamde, N,N,-dimethylacrylamide, N,N,-methylene bisacrylamide, etc.; allyl monomers such as allyl glycidyl ether, allyl methacrylate, diallyl phthalate, etc.; as well as various other monomers known in the art, including vinyl monomers, glycidyl ethers and the like.

The polymers that may be used include the commercially available low molecular weight oligomers, e.g. urethanes such as those having a molecular weight ranging from about 600 to about 8000 and containing no reactive isocyanate groups, the epoxies and the polymethacrylates, the urethanes, especially the acrylated urethanes being particularly preferred. As an example of a commercially available urethane oligomer, mention may be made of "Uvithane" (trademark of Thiokol Specialty Chemical Division).

Useful photoinitiators are also well known in the art and include the aromatic ketones such as benzophenone, diethoxyacetophenone, benzil and anthraquinone; halogenated aromatic ketones such as the chlorinated benzophenones and chlorothioxanthone; as well as other well known photoinitators.

The compositions which may be employed may include mixtures of more than one ingredient from each group. Additional reagents performing specific desired functions may also be added, e.g. flow control agents, slip aids and the like, as well as dyes, pigments and the like such as those heretofore used for appearance.

While in theory any of the light sources including the commercially available UV lights can be employed to effect curing and thereby form the artificial nail, it will be appreciated that care should be exercised to avoid any harmful effects from the radiation to either the operator or the person to whom the nails are applied. An important aspect of the present process, in its most preferred form, is the use of a so-called blacklight which emits radiation in a specific range of the spectrum to obviate any dangers inherent in the use of UV.

Accordingly, in the preferred application of the process of this invention, a blacklight lamp is used which provides wavelength of essentially around 360 nm for the curing radiation visible light, heat and the short and medium wavelength UV being effectively eliminated. More specifically, a blacklight lamp such as would be commercially available, e.g. an industrial UV spot lamp having a 100 watt capacity or rating may be provided with a glass absorption filter of known composition adapted to transmit radiation emanating from the lamp having a spectral transmittance curve exhibiting a peak at about 360 nm and a sharp cut-off with tails extending only to about 320 and about 400.

To recapitulate what has been described thus far, the artificial nail process of this invention contemplates the steps of (1) applying to one or more digits a photocurable liquid composition which is dermatologically innocuous and solvent-free, the composition being applied over the natural nail of each such digit and extending beyond, the extension preferably being in the general size and shape of the desired artificial nail; and thereafter (2) exposing the thus applied composition to actinic radiation for a time sufficient to effect curing, thereby forming a water-insoluble, hard, smooth artificial nail which can then, optionally, be subjected to any of the desired finishing touches, e.g. cutting or sanding to final shape, lacquering and the like for appearance, etc. The curing radiation is preferably UV emitted by a blacklight, and most preferably a UV curing radiation as heretofore described precluding any possible undesirable effects, including to persons having supersensitivity to actinic radiation. The photocurable liquid compositions which may be employed to provide artificial nails possessing the desired characteristics are per se known and can therefore be composed of a variety of reagents heretofore employed in the UV-curing polymer art. Typically, such compositions may contain one or more oligomers, a photoinitiator and at least one cross-linkable monomer in which the other named ingredients are soluble. The liquid composition may also contain other desired ingredients, including colorants, as heretofore mentioned.

It is important to note that the present artificial nail process is fully operative in a single coating and curing step, requiring neither a base coat for proper adhesion or any top coat or lacquer to provide required strength or rigidity to the nail. Any coating applied thereover, specifically the nail polishes or lacquers such as those customarily purchased in stores, is only for color and appearance.

Even though the process of this invention is fully operative and useful in a single step, it may be desirable, however, at least in some instances, to apply two or three coating and curing steps for a reason to be described hereinafter and the present invention accordingly contemplates such an additional step or steps.

It has been discovered that, at least in some applications, it may be desired to provide a first coating which is more flexible and will therefore contract and expand more satisfactorily with the underlying natural nail for optimum durability. Such a coating may not, because of its greater flexibility, possess the optimum firmness and rigidity, in which event an additional photocurable coating or two of lesser flexibility may be found advantageous or desirable.

One skilled in the art will readily understand how to vary the liquid coating compositions to provide such variations in rigidity, i.e. how to formulate the first coating composition and any additional ones. As previously explained, rigidity is at least in part a function of the cross-linking which occurs during the curing step and the extent of the cross-linking and thus the degree of rigidity may be varied by such factors as the selection of the particular oligomers and monomers, or mixtures thereof, varying the ratio of oligomer to monomer content, and the selection of monomers which are mono-, di-, or polyfunctional and therefore have varying degrees of reactive sites for cross-linking.

There thus has also been described a method of forming an artificial nail comprising mounting and securing a finger in a concave cavity of an artificial nail forming device with the fingernail exposed; overlying the tip of the fingernail on an artificial nail forming surface of the device, the device nail forming surface having orthogonal nail forming curvatures simulating natural nail curvatures and applying the artificial nail to the exposed fingernail and to the nail forming device nail forming surface.

It will be appreciated that the disclosed embodiments are given by way of illustration and not limitation. It will occur to those of ordinary skill that various modifications may be made to the disclosed embodiments. For example the shapes of the edges, the tabs and ears is by way of illustration and they may be made differently according to a given implementation. It is intended that the scope of the present invention be defined by the appended claims.

As examples of useful formulations, mention is made of:

EXAMPLE 1

| Ingredient | Parts by Weight |
|---|---|
| Urethane Methacrylate | 60 |
| Polymethylmethacrylate | 5 |
| Trimethylolpropane trimethacrylate | 10 |
| Isobutoxymethylacrylamide | 10 |
| Dimethoxyphenylacetone | 5 |
| N--Vinylpyrollidone | 10 |

EXAMPLE 2

| Ingredient | Parts by Weight |
|---|---|
| Epoxy Methacrylate | 60 |
| Carboxyl terminated polybutadiene | 5 |
| acrylonitrile Trimethylolpropane trimethacrylate | 5 |
| N--Vinylpyrollidone | 10 |

-continued

| Ingredient | Parts by Weight |
|---|---|
| Bisphenol A Ethoxylate Dimethacrylate | 15 |
| Benzophenone | 5 |

What is claimed is:

1. A nail form for use in creating and attaching an artificial fingernail to a natural fingernail comprising:

a unitary sheet material longitudinal member defining a longitudinal axis and having a convex outer surface and a concave inner surface, the member having front and rear sections integral with said member defined by an opening therebetween, the rear section concave inner surface for receiving a finger, the front section outer surface for forming the artificial nail; and the rear section having a means integral therewith for releasably attaching the member to the received finger such that the natural nail of the received finger is exposed through the opening with a tip nail portion overlying a portion of the front section convex outer surface, wherein said means comprising a pair of bendable ears extending transverse to a longitudinal axis of the member in opposite directions from the rear section;

the front section convex surface defining two orthogonal curvatures, the first having an axis parallel to the longitudinal axis of the member and the second normal thereto, simulating the orthogonal curvatures of a natural nail wherein the front section includes a pair of tabs extending radially outwardly therefrom in opposing directions transverse the longitudinal axis.

2. The form of claim 1 wherein the tabs extend from the front section in mirror image relationship.

3. The form of claim 1 wherein the front section terminates at first and second longitudinal edges, each tab extending from each said first and second longitudinal edges.

4. The form of claim 1 wherein the ears are for manual bending about the finger.

5. The form of claim 1 wherein the tabs are flat and approximately coplanar.

6. The form of claim 1 wherein the ears are generally flat and coplanar.

7. The form of claim 1 wherein the front section has opposite longitudinal edges, each tab extending from a different longitudinal front section edge.

8. The form of claim 1 wherein the rear section has opposite longitudinal edges, each ear extending from a different longitudinal rear section edge.

9. An artificial nail forming method comprising:

forming a unitary sheet material longitudinal member defining a longitudinal axis and having a convex outer surface and a concave inner surface;

forming the member with front and rear sections integral therewith defined by an opening therebetween and forming the rear section concave inner surface for receiving a finger, a means integral therewith for releasably attaching the member to the received finger, wherein said means comprising a pair of bendable ears extending transverse to a longitudinal axis of the member in opposite directions from the rear section;

forming the front section convex surface with two orthogonal curvatures, the first having an axis parallel to the longitudinal axis of the member and the second normal thereto simulating the orthogonal curvatures of a natural nail wherein the section includes a pair of tabs extending radially outwardly therefrom in opposing directions transverse the longitudinal axis;

attaching the rear section to the received finger such that the natural nail of the received finger is exposed through the opening with a finger tip nail portion overlying a portion of the front section convex outer surface;

forming the artificial nail;

and then separating the artificial nail from the member by pushing on the front section relative to the rear section.

10. The method of claim 9 including displacing a first portion of the nail forming device having the applied artificial nail relative to the finger to separate the artificial nail from the device nail forming surface.

11. The method of claim 9 wherein the mounting step includes mounting the finger in fixed relationship to a second portion of the nail forming device and the displacing step includes displacing the first portion of the nail forming device relative to the second portion.

12. The method of claim 9 wherein the displacing step includes pushing on the tabs.

13. The method of claim 9 wherein the mounting step includes wrapping at least one ear attached to the device about the finger.

14. A method of forming an artificial nail comprising:

mounting and securing a finger in a concave cavity of an artificial nail forming device of claim 1 with the fingernail exposed, overlying the tip of the fingernail on an artificial nail forming surface of the device, and applying the artificial nail to the exposed fingernail and to the nail forming device nail forming surface.

* * * * *

UNITED STATES PATENT AND TRADEMARK OFFICE

CERTIFICATE OF CORRECTION

PATENT NO. : 7,654,268 B2
APPLICATION NO. : 11/443609
DATED : February 2, 2010
INVENTOR(S) : June Carpenter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 639 days.

Signed and Sealed this

Twenty-third Day of November, 2010

David J. Kappos

David J. Kappos
*Director of the United States Patent and Trademark Office*